United States Patent [19]

Blanchong

[11] Patent Number: 5,040,610

[45] Date of Patent: Aug. 20, 1991

[54] DEVICE FOR EXTINGUISHING OR RETARDING FIRES

[76] Inventor: Raymond Blanchong, 9340 Salisbury Road, Monclova, Ohio 43512

[21] Appl. No.: 495,333

[22] Filed: Mar. 19, 1990

[51] Int. Cl.[5] ..... A62C 31/02

[52] U.S. Cl. ..... 169/56

[58] Field of Search ..... 169/34, 35, 36, 37, 169/38, 39, 43, 57, 58, 90, 89, 56

[56] References Cited

U.S. PATENT DOCUMENTS

| | | | |
|---|---|---|---|
| D. 115,824 | 7/1939 | Roessner . | |
| 117,891 | 8/1871 | Johnson | 169/36 |
| 430,866 | 8/1890 | Linn | 169/36 |
| 1,297,075 | 4/1884 | Harden . | |
| 2,522,020 | 9/1950 | Deyo | 169/58 |
| 2,871,952 | 2/1959 | Doak | 169/57 |
| 3,132,695 | 7/1962 | Peltier | 169/26 |
| 3,171,493 | 3/1965 | Barr | 169/57 |
| 4,779,683 | 10/1988 | Enk | 169/89 |

*Primary Examiner*—Sherman Basinger
*Assistant Examiner*—Stephen P. Avila
*Attorney, Agent, or Firm*—David C. Purdue; John C. Purdue

[57] ABSTRACT

A fire extinguishing device which provides automatic actuation upon exposure to heat is disclosed. The device comprises a vessel composed of a polymeric material and including an opening, a cap for closing the opening after a fire extinguishing medium is charged to the vessel, a valve for pressurizing the vessel after the opening has been closed. The amount of pressure in the vessel and the composition of the fire extinguishing medium and the polymeric material are controlled so that, when the vessel is exposed to heat and/or flame, a portion of the vessel near the heat/flame fails creating a second opening in the vessel, in the vicinity of the portion of the vessel which was exposed to the heat/flame.

5 Claims, 1 Drawing Sheet

DEVICE FOR EXTINGUISHING OR RETARDING FIRES

BACKGROUND OF THE INVENTION

1. Field of the Invention

The invention relates to devices for extinguishing fires.

2. Description of the Prior Art

The field of fire extinguishing devices is a highly developed one. Numerous organizations have promulgated guidelines and standards relating to the construction, testing, shipment and maintenance of fire extinguishing devices. The National Fire Protection Association and Underwriters Laboratories are especially prolific.

U.S. Pat. Nos. 117,891,297,075 and 430,866 disclose devices within a class of fire extinguishing devices generally known as fire extinguishing grenades. These devices are understood to be obsolete in the sense that they are not in general use today. Basically, a fire 15 extinguishing grenade comprises a closed, pressurized vessel containing a fire extinguishing media. The vessel is constructed of a frangible material so that the grenade, when thrown into or towards a fire, will break open upon impact, releasing the fire extinguishing media to do its work. U.S. Design Pat. No. 115,824 discloses an ornamental design for a fire extinguishing grenade.

U.S. Pat. No. 2,871,952 discloses an automatic fire extinguisher in the form of a Christmas tree ornament. The body of the ornament is adapted to hold a fire extinguishing liquid and compressed air. An impact element is held in place by a fusible link, against the action of a spring. When the fusible link is broken by exposure to heat, the impact element is released and it fractures a normally closed end portion of a hollow frangible stem which is in communication with the interior of the vessel, thereby releasing the liquid inside to extinguish the fire.

U.S. Pat. No. 3,132,695 discloses an automatic fire extinguisher in the form of a Christmas tree ornament. The body of the ornament can be made from metal and a thermally actuated valve assembly is provided on the bottom of the vessel. A fire extinguishing medium, such as carbon tetrachloride, and a propellant such as dichlorotetrafluoroethane are contained in the vessel. An opening in the vessel is normally plugged by a conical seal which is held in place by a flame sensitive screw. A highly flammable "trigger" is connected to the screw and it is adapted to quickly conduct flame to the screw, causing it to fail and release the conical seal so that the contents of the vessel will be discharged.

U.S. Pat. No. 3,171,493 discloses a fire extinguishing device for Christmas trees. The device comprises a heat actuated sprinkler head incorporated in an ornament, a canister containing a liquid fire extinguishing medium under pressure and a hose connecting the canister to the sprinkler head. The canister is provided with an auxiliary cartridge for making up pressure lost through the sprinkler head.

SUMMARY OF THE INVENTION

The present invention is based upon the discovery of a fire extinguishing device which provides automatic actuation upon exposure to heat. The device comprises a vessel composed of a polymeric material and including an opening, a cap for closing the opening after a fire extinguishing medium is charged to the vessel, a valve for pressurizing the vessel after the opening has been closed. The amount of pressure in the vessel and the composition of the polymeric material are controlled so that, when the vessel is exposed to heat and/or flame, a portion of the vessel near the heat/flame fails creating a second opening in the vessel, in the vicinity of the portion of the vessel which was exposed to the heat/flame.

DETAILED DESCRIPTION OF THE PREFERRED EMBODIMENTS

Figure 1:
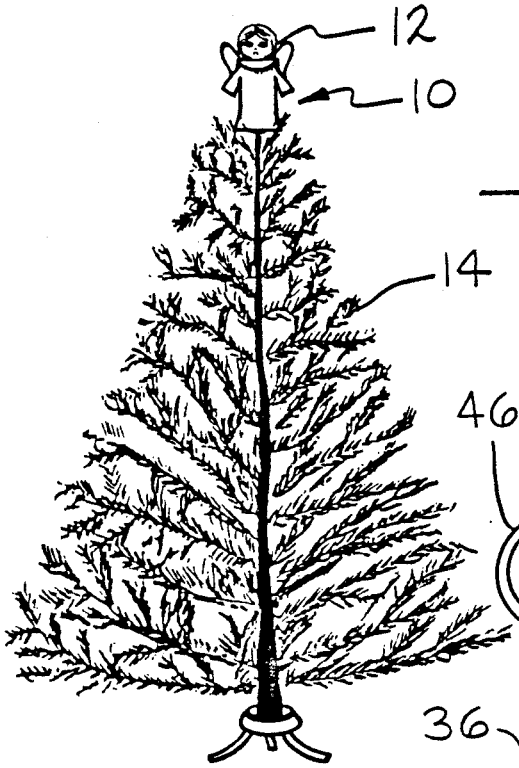
FIG. 1 is a perspective view of the device, including a decorative cover, supported at the top of a Christmas tree.

With reference to FIG. 1, a device for extinguishing fires is indicated generally at 10. The device 10 includes a decorative cover 12 which is illustrated as an angel, although it could take virtually any appropriate form. The device 10 is shown atop a Christmas tree 14, one of the most flammable items which can be found in homes today.

Figure 2:
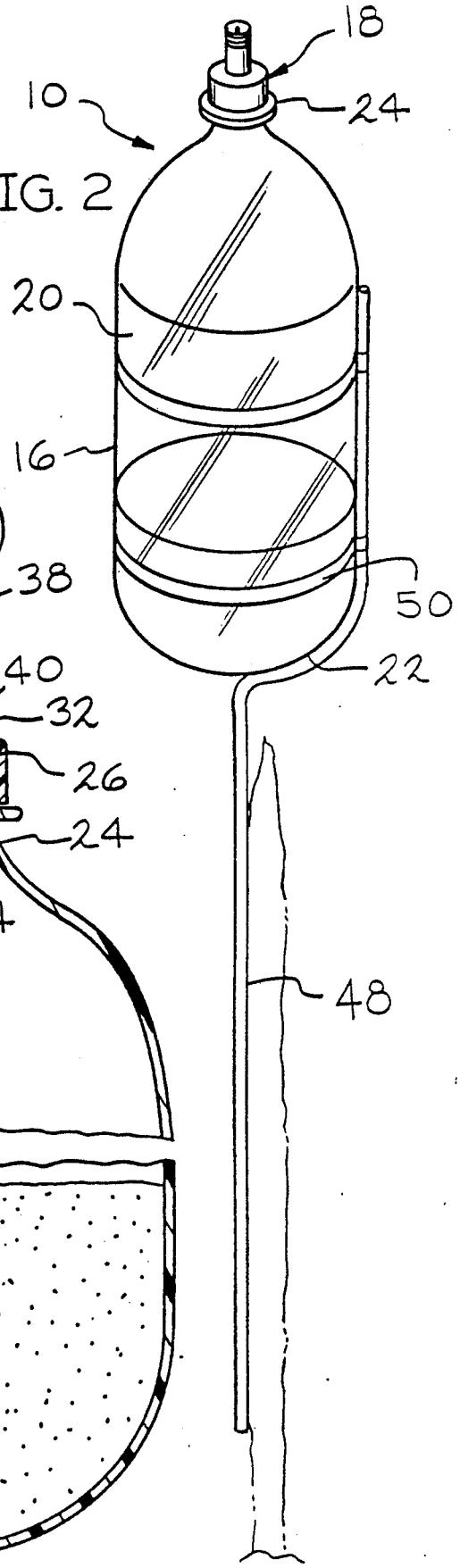
FIG. 2 is a perspective view of the device with its decorative cover removed

With reference to FIG. 2, it will be seen that, under decorative cover, the device 10 comprises a polymeric vessel 16, a valve and cap assembly 18 and a fire extinguishing medium 20 contained in the vessel 10.

The vessel 16 is composed of a polymeric material and certain polymeric vessels of the type used in the soft drink industry have been found to very well suited for this purpose. Specifically, two liter polymeric containers of the type currently used by virtually all of the major soft drink bottlers have been found to be very effective vessels for use in devices according to this invention. These containers are composed of plastic and methods for producing them are well known to those in the packaging art. They are extremely thin walled and can withstand very high internal pressures. These containers are subject to failure by cracking and by thermal degradation. When such containers are filled with a soft drink, thermal degradation does not occur because the soft drink is liquid and prevents the container from reaching a temperature at which thermal degradation would occur. Failure by cracking in these containers is known to those in the soft drink industry. Generally, cracking failure in such containers is messy but not dangerous as in the case of glass soft drink containers where glass shards can be sent hurtling through the air and cause injury when they strike someone.

Figure 3:
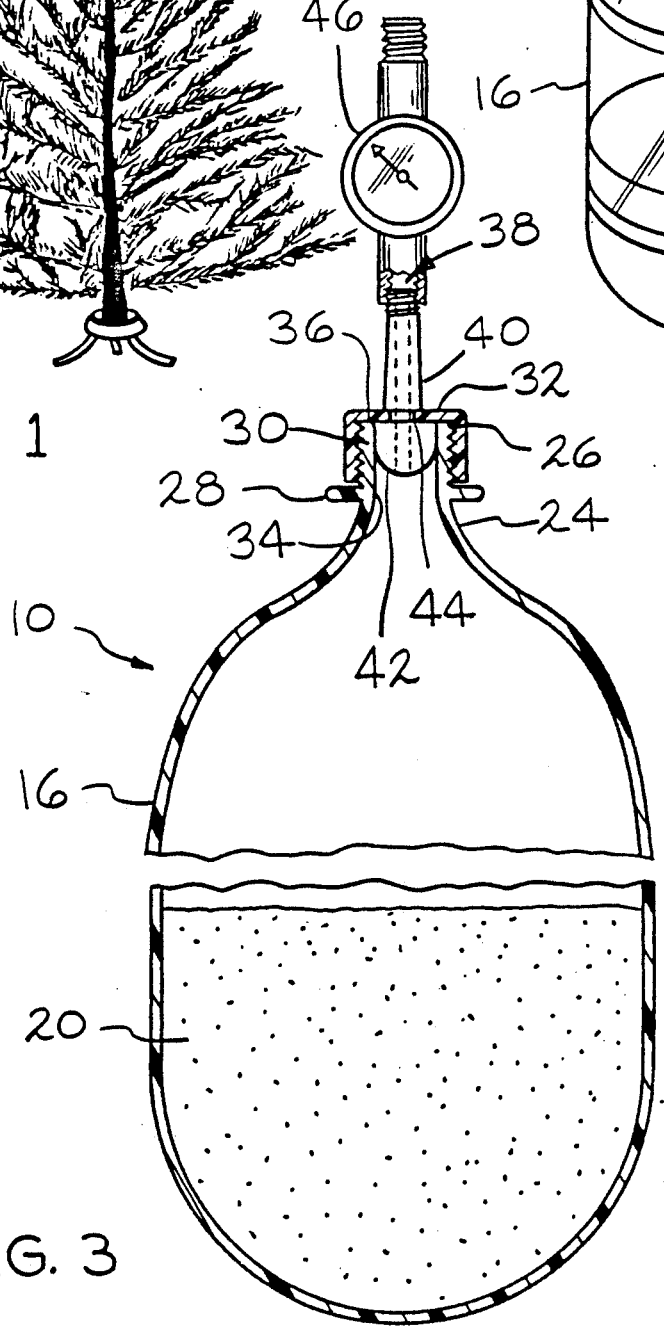
FIG. 3 is a view in partial section through the device illustrating the valve assembly.

The vessel 16 has a rounded bottom as at 22 and a tapered top which narrows down to a neck 24 and terminates in an open end 26 as shown in FIG. 3. The neck 24 of the vessel 16 includes a circumferential flange 28 and, above the flange 28 there is a portion, indicated at 30, which is externally threaded. A cap 32 is internally threaded, as indicated at 34, with threads corresponding with the threads provided on the externally threaded portion 30. In a known manner, the neck 24 terminates in an end 36 and a liner (not numbered) is provided on the interior surface of the cap 32. When the threads 34 on the cap 32 are engaged with the threaded portion 30 of the vessel 16 and the two are rotated clockwise relative to one another, the end 36 of the vessel 16 will engage the liner in the cap 32 and a hermetic seal is established therebetween.

A conventional tire valve 38 including a valve stem 40 and a valve ball 42 is supported in the cap 32. Specifically, the valve stem 40 extends through an opening (not shown) provided in the cap 32. When the cap and valve assembly is secured on the vessel 16 internal pressure in the vessel will seal the valve ball against an interior surface 44 of the cap 32.

A fire extinguishing medium 20 is contained in the vessel 16. Good results have been obtained in tests performed with a medium 20 consisting of sodium bicarbonate. Other suitable chemical fire extinguishing mediums will certainly occur to those skilled in the art and their selection and use is certainly within the scope of the present invention. Dry fire extinguishing mediums are preferred and, when they are used, the use of an anti-caking compound is desirable.

The device 10 is produced by introducing a quantity of a fire extinguishing medium into the vessel 16. In a two liter vessel, a volume of approximately one half of one cup of sodium bicarbonate has been found to produce good results. More may be used although the amount should be controlled because, if there is too much medium in the vessel, poor discharge characteristics will result. Less medium may be used so long as there is enough medium to achieve the desired result of extinguishing or at least substantially retarding a fire.

The vessel 16 containing the medium 20 is then closed by screwing the cap and valve assembly 18 onto the neck portion as described above. Enough torque should be applied to create a strong seal between the end 36 of the vessel 16 and the liner (not shown) in the cap 32, without over stressing the threads on the cap 32 and the neck 24 of the vessel 16. A pressurizing medium is then introduced into the vessel 16 through the valve 38. Nitrogen is a good, inert pressurizing medium and others will readily occur to those skilled in the field of fire extinguishing devices.

EXAMPLES

EXAMPLE 1-A

A two liter plastic soft drink bottle, specifically, a Dr. Pepper bottle, was charged with approximately one half of one cup of sodium bicarbonate and a cap and valve assembly corresponding substantially with the assembly 18 was secured to the bottle to establish a hermetic seal. Carbon dioxide was charged to the vessel, through the valve until the pressure inside the vessel was approximately 50 pounds per square inch gauge.

A fire was started in a fire place with pine tree boughs as the primary fuel, and the fire was allowed to spread, for approximately 30 or 40 seconds, until it was a substantial fire. The fire extinguishing device produced in accordance with this Example was suspended, by fire place tongs, directly over the fire. after approximately 3 seconds, there was a failure in the wall of the bottle, near the rounded bottom of the bottle. The failure was evidenced by a hole, perhaps four inches in diameter, in the wall of the container. As a consequence, there was a rapid and explosive discharge of the sodium bicarbonate into the fire. Immediately, the flames were extinguished and the pine tree boughs were scattered in the fireplace. Some of the pine tree boughs were observed to be still glowing after everything settled. The glowing boughs did not reignite, however. Rather, they stopped glowing after approximately 10 or 15 seconds. Accordingly, this test was deemed to be successful. Other tests were conducted on similar devices, some according to the present invention and some outside of the present invention. Examples of devices according to the invention are discussed in the Examples below.

EXAMPLE 1-B

A second device substantially similar to the one described above in Example 1-A was produced. This device was tested in the following manner. A fire was ignited in a fire place with pine tree boughs as the primary fuel. When the fire was burning well, the device produced in accordance with this Example was tossed into the fire and came to rest on its side among the burning pine tree boughs. Within 3 or 4 seconds, there was a failure in the wall of the bottle. As a consequence, there was a rapid and explosive discharge of the contents of the vessel. Immediately, the flames were extinguished but, after a few seconds, the pine tree boughs reignited. It was determined, thusly, that best results are obtained when a device according to the present invention is suspended over, rather than deposited in, a fire to be extinguished.

EXAMPLE 2

A device, similar to the one described above in Examples 1-A and 1-B was produced, except that three quarters of a cup of sodium bicarbonate was charged to the vessel along with carbon dioxide to a pressure of 50 psig. The device was tested, substantially in accordance with the procedure described above in Example 1-A, with similar results. That is, 3 or 4 seconds after the device was suspended over the flame, there was a failure in the wall of the vessel, near the rounded bottom of the vessel. The failure was evidence by a nole, perhaps four inches in diameter, in the wall of the container. As a consequence, there was a rapid and explosive discharge of the sodium bicarbonate into the fire. Immediately, the flames were extinguished and the pine tree boughs were scattered in the fireplace.

EXAMPLE 3

A device, similar to the one described above in Examples 1-A and 1-B was produced, except that one cup of sodium bicarbonate was charged to the vessel along with carbon dioxide to a pressure of 50 psig. The device was tested, substantially in accordance with the procedure described above in Example 1-A, with similar, but less successful results. That is, 3 or 4 seconds after the device was suspended over the flame, there was a failure in the wall of the vessel, near the bottom of the vessel. The failure was evidenced by a hole, perhaps four inches in diameter, in the wall of the vessel. As a consequence, there was a rapid and explosive discharge of the sodium bicarbonate into the fire. Immediately, the flames were extinguished and the pine tree boughs were scattered in the fireplace. There was no reignition of the pine tree boughs after one minute, although glowing embers were still visible, unlike the case with Examples 1-A and 2.

For purposes of comparison, but not in accordance with the principles of the present invention, other devices were produced and tested. A description of the devices and the results of their testing is set forth below.

CONTROL 1

Sodium bicarbonate, in an amount substantially greater than 1 cup, was charged to vessel consisting of a two liter plastic bottle. The vessel was pressurized with air to approximately 50 psig and tested for its ability to extinguish a fire consisting primarily of burning newspapers. A newspaper fire was started in a fireplace and, after it was burning well, the device was suspended over the flames. After the device had been exposed to the flames for approximately 3 or 4 seconds, there was a failure in the wall of the vessel. There was a rapid and explosive discharge of the contents of the bottle, although a substantial volume of sodium bicarbonate remained in the vessel. The flames were not extinguished, however, and the fire continued to burn in the fireplace.

CONTROL 2

A device similar to the one described above in Control 1 was produced except that it contained a greater amount of sodium bicarbonate. The device was tested in a substantially the same manner described above in Control 1. After there was a failure of the wall of the vessel, the contents of the vessel were discharged and the flames were extinguished. A few seconds after the flames were extinguished, the fire reignited.

CONTROL 3

A device similar to the one described above in Control 2 was produced except that it contained approximately half the volume of sodium bicarbonate. The device was tested in a substantially the same manner described above in Control 1. After there was a failure of the wall of the vessel, the contents of the vessel were discharged and the flames were extinguished. The flames remained extinguished for 30 or 40 seconds, whereupon the fire reignited.

Other devices, not in accordance with the invention, were produced and pressurized with air but at lower pressures than 50 psig. Specifically, pressures of approximately 30 and 40 psig were used, but the discharge of sodium bicarbonate which resulted did not satisfactorily extinguish a fire when these devices were tested. It may be that the lower pressures would be operable in combination with a different pressurizing medium, such as nitrogen or carbon dioxide, or a different fire extinguishing medium.

The bottle used in the tests described above was composed of plastic and had a nominal wall thickness of 12 thousandths of an inch (0.012 inches). In a number of tests which were deemed to be unsuccessful, failure of the plastic bottle vessel involved a splitting of a portion of the wall of the vessel as opposed to the kind of failure note above the Examples.

It may be desirable in some applications to provide the device with means for gauging the pressure in the vessel. For example, a gauge 46 is provided on the stem 40 so that it registers the internal pressure (gauge or absolute). The gauge may include a plate with indications showing that the internal pressure is within design limits for proper operation of the device, as is known in the field of fire extinguishing devices.

The device 10 can be attached to a Christmas tree, or other object, by any suitable means. A mounting rod 48 is provided and it is secured to the vessel 16 by straps 50. The lower end of the rod can be secured to a branch on the Christmas tree, or anything else on which the device 10 is to be mounted.

It will be appreciated that fire extinguishing mediums other than sodium bicarbonate can be used in a device according to the present invention. Those skilled in the art can readily select, from known and yet to be discovered dry fire extinguishing mediums, ones that are suitable for use in devices according to the invention. It would be advantageous to employ an anti-caking agent in the fire extinguishing medium to keep it flowable.

I claim:

1. A device for extinguishing or retarding fires, said device comprising a non-frangible vessel with an opening, said vessel being composed of a given polymeric material having a given thickness, a cap for sealing the opening in the vessel, a valve for charging a pressurizing medium into the vessel and a given amount of a substantially dry fire extinguishing medium contained within the vessel, wherein, the vessel is pressurized to a given pressure and wherein the given pressure, the composition of the polymeric material which forms the vessel, the composition of the fire extinguishing medium, the thickness of the vessel wall and the given amount of the fire extinguishing medium are controlled so that, when the device is exposed to substantial heat or flame, the vessel wall will quickly fail creating a hole in the vessel wall caused by thermal failure of the polymeric material so that the fire extinguishing medium will be discharged through the hole.

2. The device claimed in claim 1 wherein the pressure within the device is approximately 50 psig.

3. The device claimed in claim 1 which further comprises gauge means for providing a visual indication of the amount of pressure within said vessel.

4. The device claimed in claim 1 wherein the valve and cap together constitute a valve and cap assembly.

5. The device claimed in claim 1 wherein the cap is threadedly engaged on the vessel.

* * * * *